US005490559A

United States Patent [19]

Dinulescu

[11] Patent Number: 5,490,559

[45] Date of Patent: Feb. 13, 1996

[54] HEAT EXCHANGER WITH FINNED PARTITION WALLS

[76] Inventor: Horia A. Dinulescu, 11217 Fetterly Rd., Minnetonka, Minn. 55305

[21] Appl. No.: 278,041

[22] Filed: Jul. 20, 1994

[51] Int. Cl.[6] ..... F28D 1/053; F28F 1/22

[52] U.S. Cl. ..... 165/148; 165/165; 165/183

[58] Field of Search ..... 165/148, 149, 165/165, 166, 183

[56] References Cited

U.S. PATENT DOCUMENTS

| | | | |
|---|---|---|---|
| 2,804,285 | 8/1957 | Peterson | 165/166 |
| 2,874,941 | 2/1959 | Woolard et al. | 165/164 X |
| 2,985,434 | 5/1961 | Boring et al. | 165/166 |
| 3,528,496 | 9/1970 | Kun | 165/166 |
| 3,693,710 | 9/1972 | Drosnin | 165/152 |
| 4,461,344 | 7/1984 | Allen et al. | 165/165 X |
| 4,729,428 | 3/1988 | Yasutake et al. | 165/166 |
| 4,949,543 | 8/1990 | Cottone et al. | 165/133 |
| 5,042,574 | 8/1991 | Cottone et al. | 228/183 |
| 5,102,032 | 4/1992 | Cottone et al. | 228/183 |
| 5,277,358 | 1/1994 | Cottone et al. | 228/183 |

FOREIGN PATENT DOCUMENTS

| | | | |
|---|---|---|---|
| 0490210 | 6/1992 | European Pat. Off. . | |
| 580652 | 9/1946 | United Kingdom | 165/153 |

*Primary Examiner*—Leonard R. Leo

[57] ABSTRACT

In a heat exchanger with confronting partition walls (50) separating two fluids, extended surface for heat transfer enhancement is provided by extended surface packets (42), each comprising a multiplicity of fins (44), made integral with a common base plate (56) and a common top plate (62); packets (42) being attached to adjacent walls (50) through junction layers (68) formed by a bonding process. The partition walls (50) are typically constituted by the flat walls of oblong cross section tubes (34). In a preferred embodiment, for low temperature applications such as an air-cooled steam condenser for electric power generation plants, tubes (34) are made of steel, extended surface packets (42) are made of aluminum by extrusion, and bonding is by an organic structural adhesive. In another preferred embodiment, for high temperature applications such as heat recovery steam generators of combined cycle power plants, tubes (35) are of a high temperature metal; extended surface packets (43) are of a similar metal and made without a top plate; and attachment of packets (43) to tubes (35) is by diffusion bonding. Numerous other applications are identified. Depending on the application, the heat exchanger can be constructed of many materials, which can be similar or dissimilar for walls (50) and extended surface packets (42); bonding can be by brazing, soldering, diffusion bonding, and an organic structural adhesive.

6 Claims, 5 Drawing Sheets

24
8
28
34
30
20
26
22
8

24
28
32
26

38
40
44
H
30
34
36
36
32
B
52
54
D
50
40
38

HEAT EXCHANGER WITH FINNED PARTITION WALLS

TECHNICAL FIELD

This invention relates to heat exchangers with finned heat transfer surface, and more specifically it relates to heat exchangers in which fins are connected to a flat surface.

BACKGROUND ART

Heat exchangers with fins attached to surfaces for heat transfer enhancement are widespread in many industrial and household applications. The most commonly encountered constructions include round tubes with helically wound aluminum or steel fins, in which the fins are maintained in thermal contact with the tube by the tension imparted during the winding process. Several variations exist, including sometimes a groove formed in the tube in which the fin is embedded for better thermal contact, and in other instances the fin being high frequency resistance welded to the tube for increased strength. While these tubes are relatively easy to make, they present a number of disadvantages, among which are high pressure loss in the fluid flowing through the fins and inefficient use of fin material. The high pressure loss is caused by the resistance to flow presented by the numerous tubes around which the fluid must turn, as indicated by arrows in FIG. 1. The inefficient use of the fins is caused by the stagnant fluid regions forming behind each tube in which heat transfer does not occur; the portions of the fins adjacent to these regions, represented by hashed areas in FIG. 1, could as well be cut out without reducing the total heat transfer, but of course this cannot be done conveniently.

The round finned tube disadvantages can be eliminated by the flat finned tube construction. As shown in FIG. 2 the flat finned tube is made of an oblong cross section tube with two parallel flat walls and straight fins attached to the two walls. A flat finned tube can replace several round tubes, and its slender profile, allows fluid flow with no turns, and thus with no resistance, as indicated by arrows in FIG. 2. There are no stagnant fluid regions and the fins are heat transfer effective over their entire extent. The net result is a heat exchanger with improved energy efficiency and of markedly reduced size. Consequently, the flat finned tube has :first found applications where these two factors are at a premium, namely in automotive vehicular heat exchangers, such as car radiators, and in the air-cooled steam condensers of electric power generation plants.

Due to the large surface carrying capacity of the flat finned tubes, a heat exchanger consists often of a single row of tubes as shown in the perspective sketch of FIG. 3. As shown in the figure, the fins can be attached to each of two neighboring tubes, uniting all tubes in a structure of high rigidity which is further advantageous and not possible to achieve with round finned tubes. In typical applications a liquid or a condensing fluid is circulated through the inside of the tubes, and cooling air is forced over the external tube surfaces and through the fins. Not shown in the figure are the supporting frame, the headers for bringing the inside fluid in and out of the heat exchanger, and the fan and ducts for air circulation, considering that these are easily understood conventional components.

In actual applications the flat tube dimensions can vary greatly. Thus, in a vehicular heat exchanger, the tubes may have approximately dimension B of 20 millimeters, dimension D of 2 millimeters, fin width H of 10 millimeters, fin thickness of 0.2 millimeters, fin pitch of 2 millimeters, and the tube length of about 0.5 meters; in a power plant air-cooled steam condenser the tubes may have approximately dimension B of 300 millimeters, dimension D of 20 millimeters, fin width H of 40 millimeters, fin thickness of 0.4 millimeters, fin pitch of 3 millimeters, and the tube length of about 10 meters. This wide range of sizes available for the flat finned tubes is not possible with the round finned tubes and constitutes an additional advantage allowing greater versatility and further reduction of the heat exchanger dimensions.

Despite their advantages over the round tubes, the flat finned tubes, as currently practiced, present a number of deficiencies which have prevented their widespread use in place of the round tubes.

One difficult problem is that of creating a fin to tube attachment of high strength. While on a round tube the fin is maintained rather securely around the tube by the tension imparted during its winding, in a flat finned tube the fin is simply posed on the flat tube wall and must be attached by a bonding process. As shown in FIG. 4, which is an enlargement of the encircled area of FIG. 3, the fins are usually supplied as waved strips attached to the tube at the wave apexes. The attachment area is of limited width, of approximately twice the fin thickness which is very small compared with the fin height, thus creating a spot for the amplification of stresses due to tube movements by vibration or thermal expansion. Thus, unless the attachment is of considerable strength everywhere, the fins can become detached losing thermal contact with consequent loss of the heat exchanger performance. U.S. Pat. No. 3,693,710 to Dorsnin (1972) attempts to solve this problem by bonding with metal solder and providing a large number of perforation in the fin wave apex through which the solder penetrates to the other side of the fin, thus increasing the area of attachment; this method has the disadvantage of increasing the extent of the fin to solder junction which is exposed to the environment and thus aggravates the galvanic corrosion problems inherent in soldered junctions.

The strength problem is addressed by U.S. Pat. No. 4,949,543 to Cottone et al. (1990), by creating a metallurgical bond between each fin and the tube, through brazing in a controlled atmosphere furnace. While the bond strength is therefore increased, the process is carried at high temperature, exceeding 600° C., and when applied to aluminum fins the high temperature leads to full annealing of the fins which are thus softened and made prone to denting during assembly or cleaning, causing closure of the air channels and subsequent reduction of the heat exchanger performance. The process is rather expensive and is not universally applicable to all desirable tube and fin materials.

In the European patent EP 0 490 210 A1 to Borchert et al. (1992), the solution to the strength problem is given by spot welding the fins to the tube with a laser beam from the underside of the tube wall; subsequently the tubes are immersed in a bath of molten zinc to provide the needed thermal contact between each fin and the tube, but not to add to the strength. The tubes have to be made of two halves which are subsequently welded. The process seems highly laborious and costly, with the many steps involved, and with the large bath of molten zinc required for tubes of about 10 meters length. Moreover, the process is limited to application of steel fins to steel tubes, and cannot be used for other materials, such as aluminum fins which are often preferable for their high thermal conductivity and increased heat transfer performance. The fin style used is essentially similar to that depicted in FIG. 4; in addition a different fin style is also indicated, consisting in separately mounted fins, as shown in FIG. 5, which while not better from the strength point of view would be prohibitively laborious to make in many applications, such as the car radiator with its small and very numerous fins.

Another difficult problem with the flat finned tubes is that of assuring the corrosion resistance of the fin to tube junction which is narrow and long. As seen from FIGS. 4 and 5, representative for the current state of the art, each fin is attached to the tube by a very narrow junction formed of some bonding filler material, shown in the figures by the darkened spots at the base of the fin. The total length of these junctions over the many fins and tubes of a heat exchanger is very large, e.g., of about 300 meters for a vehicular heat exchanger, and about 300,000 kilometers for a power plant air-cooled steam condenser. The tube and fin materials are often dissimilar, such as steel and aluminum, or if they are of the same metal the solder or brazing filler is still a different metal, such that galvanic corrosion is likely to occur since the junction is exposed to the environment formed by the fluid flowing over the fins. Even if this fluid is ambient air, it often contains moisture such as from road splash and rain, laden with salts, or even acids in an industrial environment. The junction must be of very specialized nature to resist corrosion and a different solution must be given for every environment and every desirable combination of fin and tube materials. The quality control methods should be quite extraordinary and costly to assure the required quality of the very long junction line, and in practice defects are always allowed with the result that part of the junction line will suffer corrosion and become detached, with consequent reduction of the heat exchanger performance. Solutions given to this problem to the present time are only partial, costly, and not devoid of associated problems.

The corrosion problem is solved by U.S. Pat. Nos. 4,949,543 (1990), 5,042,574 (1991), 5,102,032 (1992), and 5,277,358 (1994), all to Cottone et al., for aluminum fins attached to a steel tube by brazing in a nitrogen atmosphere furnace. The tube is made of steel coated with an aluminum layer, and the fins are formed from multilayered laminated aluminum sheet with two layers of brazing aluminum alloy. The rather complex manufacturing process takes place at high temperature and therefore must employ fluxing and zone temperature control to prevent formation of brittle and corrosion prone aluminum-iron alloy in the fin to tube junctions. The use of aluminum coated steel in place of simply steel, and of multilayered laminated aluminum sheet add to the cost and the method cannot be extended to other desirable tube and fin materials.

In the European patent EP 0 490 210 A1, already mentioned, the solution to the corrosion problem is given by coating with zinc large heat exchanger sections after assembly, by immersion in a bath of molten zinc. Since that patent refers to power plant steam condensers the sizes involved are very large and the required molten zinc bath is correspondingly large and costly. It can also be mentioned that zinc is not an entirely environmentally friendly metal and its spread in the environment should be prevented, which is very difficult with the very large amounts of zinc handled, of very high temperature and evaporating from the bath. Moreover, most of the zinc applied in a power plant steam condenser will wash into the ground during the life of the equipment, and may reach the groundwater. This is not a negligible problem with the large amounts of zinc involved which can be as much as 3000 tons for one power plant.

It may be apparent from what was said above that the flat finned tube construction and methods of manufacturing should be improved to reduce cost and expand the range of applications.

In car radiators and power plant steam condensers the operating temperature is rather low, of less than about 100° C., and the same is true for other potential applications of the flat finned tube, such as condensers and evaporators in air conditioning units. By contrast, the current manufacturing processes are based on brazing and zinc aided bonding which are complex high temperature processes.

For low temperature applications, such as power plant steam condensers and car radiators, it would be desirable to attach the fins to the flat tube by bonding with an organic structural adhesive,—a highly developed technique, with many adhesive formulations available for temperature levels in excess of those required. If bonding with an organic structural adhesive could be adopted to flat finned tubes this would represent a great improvement of the manufacturing process which could be carried at ambient temperature and by simple means. Desirable though as it is, bonding by organic structural adhesives has not been applied to date to flat finned tubes for several reasons. First, with reference to FIG. 4 again, it can be noticed that the fin to tube junction is very narrow, of the order of one fin thickness for each fin; if the bonding filler material, indicated in the figure by the darkened spots at the base of the fin, is an organic adhesive, this would not have sufficiently high thermal conductivity to allow the transfer of heat between tube and fins through the narrow cross section available. Second, the bond would not have sufficient strength to withstand the stresses transmitted to the joint by tube vibration and thermal expansion movement. Third, the very long line of the joint discussed before will expose the thin layer of adhesive directly to the moisture carrying environment leading to loss of strength in relatively short time. Although organic structural adhesives are being applied to achieve structures of high strength even in the highly demanding aerospace industry, their application is adequate only for joints of sufficiently large contact area, and line contacts such as formed here by the fin to tube junction are to be avoided. Even if the fin style is modified as shown in FIG. 5, the contact area is still insufficient to achieve strength, and the problem of the very long line of exposed junction is still present. Thus, this highly desirable manufacturing method could not be adopted for flat finned tubes.

Besides the application domains already mentioned there exist others in which the flat finned tube would be beneficial. Such is the potential application to boiler tubes in heat recovery steam generators for combined cycle power plants, in which round finned tubes are presently used with the combustion gases circulated through the fins. For these the current state of the art discussed above would certainly not work due to the corrosive nature of the combustion gases and the high temperatures involved. Neither would the current state of the art be applicable to other high temperature heat exchangers such as gas turbine recuperators.

The present invention resolves the above identified problems of the flat finned tubes and makes possible their application at low temperatures as well as at high temperatures, for cooling with air as in car radiators and power plant steam condensers, or for heating with combustion gases in power generation equipment. Moreover, the present invention makes possible a simpler and more economic manufacturing method.

In addition, the invention will be also applicable to plate-fin heat exchangers in which the flat tubes are replaced by flat parallel plates and the fins are applied on both sides of each plate, as depicted schematically in FIG. 6. Plate-fin heat exchangers are found in numerous applications, such as in air liquefaction and gas turbine compressor intercoolers. The tube walls or the plates can be thought of as representing partition walls separating two fluids exchanging heat, while having in common the same problems associated with the attachment of a straight fin to a flat wall. Therefore the invention is described in the general terms of finned partition walls rather than just flat finned tubes.

OBJECTS OF THE INVENTION

It is the principal purpose of this invention to provide a new and improved flat finned tube construction that may be used in heat exchangers, such as power plant air-cooled steam condensers and automotive vehicular heat exchangers, and to extend the use of this construction to other domains of the heat transfer technology in which it has not been previously applied.

Accordingly, it is an object of the invention to achieve a flat finned tube construction of high strength, applicable to a wide range of tube and fin materials, which can be similar or dissimilar, metallic or non-metallic.

Another object is to achieve a new means of fin to flat wall connection that eliminates the narrow and very long junctions of the current state of art, and provides improved thermal contact and high corrosion resistance.

A further object of the invention is to introduce a greatly simplified manufacturing method of the flat finned tubes used for low temperature heat exchangers such as air-cooled steam condensers and automotive vehicular heat exchangers, consisting essentially in connecting the fins to the tube by bonding with an organic structural adhesive.

It is an object of the invention that, when connection of aluminum fins to a steel tube by an organic structural adhesive is permissible by the intended heat exchanger application, this method of manufacturing will allow further improvement of corrosion resistance by anodizing the fins, or coating the tube and fins with a corrosion resistant material, separately, prior to their attachment.

Still further it is an object of the invention to achieve a flat finned tube construction for high temperature heat exchangers such as heat recovery steam generators and gas turbine recuperators.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of combinations particularly pointed out in the appended claims.

DISCLOSURE OF INVENTION

According to the present invention, the foregoing and other objects and advantages are attained by connecting groups of fins to the walls of flat tubes in a heat exchanger, through the intermediary of common base plates made integral with the fins. Junctions between individual fins and the wall are eliminated, and with them are eliminated the strength problems, the corrosion problems, and the construction materials limitations of the prior art. The fins are on one side of the base plate and the other side of the base plate is flat and intimately contacting the wall to which the fins are to be connected. The fins and base plate are made from a uniform material, in one piece, always with a multiplicity of fins for each base plate, and a heat exchanger will comprise typically more than one such fin-base-plate piece. The fin-base-plate pieces are made as large as possible for the application intended and by the manufacturing equipment available. Each fin-base-plate piece can be thought of as constituting a packet of extended heat transfer surface, made in such manner that the base plate and its associated fins define a three dimensional body which contains no internal junctions. In a variant of the invention the extended surface packet also includes a top plate made integral with the rest of the packet, similar to the base plate and contacting a neighboring tube wall.

According to the invention, the extended surface packets comprising the fins are bonded to the wall surface through the entire under face of the base plate (and the entire upper surface of the top plate if included), thus extending by about an order of magnitude, over the prior art, the area of contact allowed for each fin. By this feature the thermal contact is greatly improved and the limitations of the prior art bonding methods are eliminated. Bonding takes place between two properly laying surfaces of large extent, thus achieving strength; the junction region of the two surfaces is substantially sealed from the environment by the matching surfaces themselves, thus achieving corrosion resistance. The bonding process is simplified, and if the temperature of use of the heat exchanger is relatively low, brazing can be replaced by less expensive soldering and soldering can be replaced by highly convenient bonding with an organic structural adhesive. For heat exchangers operated at temperatures above those allowed by brazing, the attachment of the two faying surfaces can be accomplished by diffusion bonding.

In accordance with one aspect of the invention, a heat exchanger is achieved in which the partition walls are constituted by the flat walls of oblong cross section tubes, and the extended surface packets—comprising the fins, the base plate and the top plate—are attached by the base and top plates to neighboring tube walls. The tubes are made of steel, the fins are of aluminum, and the attachment is accomplished by bonding with an organic structural adhesive. The heat exchanger thus achieved is of high structural strength and can withstand substantial external loads, or internal forces due to the positive or negative pressure of the fluid circulated inside the tubes. The tube assembly being performed at low temperature, the fins are not softened, as was the case with brazing, and the corrosion resistance properties of the original materials are maintained intact. Further, the fins can be anodized prior to connection to the tube, or the tube and fins can be separately coated with a corrosion protection primer prior to their assembly, to achieve even higher corrosion resistance, if required. Although this type of heat exchanger can be used only for relatively low temperature fluids, its potential range of applications is very extensive, including power plant air-cooled steam condensers and a variety of automotive vehicular heat exchangers.

In another aspect of the invention the fins and the tubes are made of a high temperature metal, and are joined by diffusion bonding. The resulting flat finned tube can be used for high temperature applications such as heat recovery steam generators in combined cycle power plants, and in gas turbine recuperators.

According to the invention, the tubes and fins can be made of many materials and can be bonded by brazing, soldering, diffusion bonding, or with an organic structural adhesive, the selection of the material and the bonding method depending on the temperature of use and the nature of the heat exchanger fluids. All metals which are commonly used in heat exchangers can be utilized, and the invention can be applied even with non-metallic tubes, made e.g., of a polymeric plastic.

The flat finned tubes of the present invention, using an integral common base plate to connect groups of fins to the tube walls, thus solves in a radical manner the strength problem and the corrosion resistance problem associated with the fin to tube line contacts of the prior art. This allows the generalization of application of the more efficient flat finned tubes in place of round finned tubes, in heat exchangers, increasing their energy efficiency, reducing their size, and lowering their cost.

REFERENCE NUMERALS IN DRAWINGS

20—steel structure supporting the heat exchanger
22—fan
24—inlet duct
26—outlet duct
28—fluid flowing inside the tubes
30—fluid flowing over the tubes and between the fins
32—flat finned tube heat exchanger
34—flat tube
35—flat tube made of two shells
36—tube end
38—tube sheet
40—recess in tube sheet
42—extended surface packet with base plate and top plate
43—extended surface packet with the top plate deleted
44—fin
46—fin root
48—fin tip
50—tube wall
52—one flat side of tube wall
54—the other flat side of tube wall
56—base plate of extended surface packet
58—under face of base plate
60—upper face of base plate
62—top plate of extended surface packet
64—under surface of top plate
66—upper surface of top plate
68—junction between an extended surface packet and the tube wall
70—bonding filler material
72—pair of contacting fins
74—spacer ridges
76—brazing sheet
78—solder metal rod
80—internal struts of high pressure flat tubes
82—strut ends
84—tube shell
86—longitudinal edge of tube shell
88—heat exchanger plate
90—extended surface packet
92—first flat side of heat exchanger plate
94—second flat side of heat exchanger plate
96—first heat exchanger fluid
98—second heat exchanger fluid

DESCRIPTION OF THE PREFERRED EMBODIMENTS

Figure 7A:
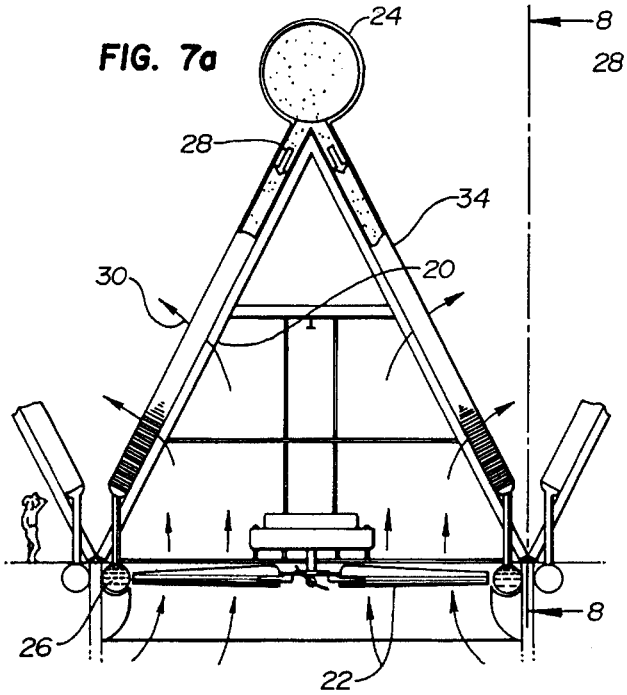
FIG. 7*a* is a sectional view of an air-cooled steam condenser embodying fin and tube assemblies made according to the invention.
Figure 7B:
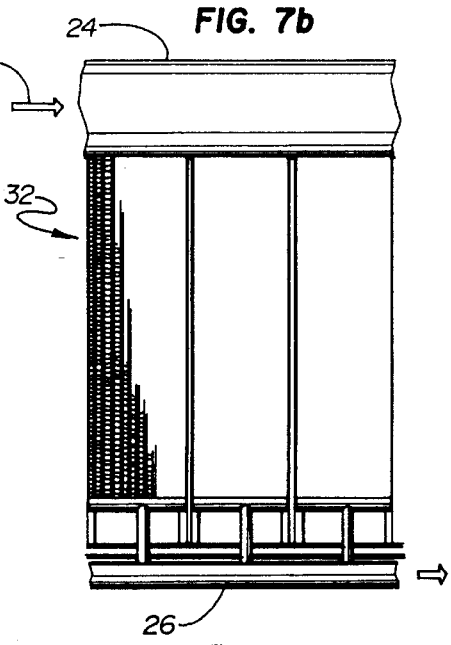
FIG. 7*b* is a sectional view as, seen from line 8—8 of FIG. 7*a;*

A typical embodiment of the present invention is illustrated in FIGS. 7*a*, 7*b*, 8, 9, and 10. FIGS. 7*a* and 7*b* illustrate an air-cooled steam condenser incorporating more than one flat finned tube heat exchanger 32. A fluid 28, consisting essentially of saturated steam and condensate mixture, is circulated through the interior of the heat exchanger tubes, and a fluid 30, consisting of ambient air, is flown over the exterior surfaces of the tubes. The steam condenser further includes a fan 22 for the air, an inlet duct 24 and an outlet duct 26 for the steam, and a steel structure 20 for supporting the weight of the condenser elements.

Figure 8:
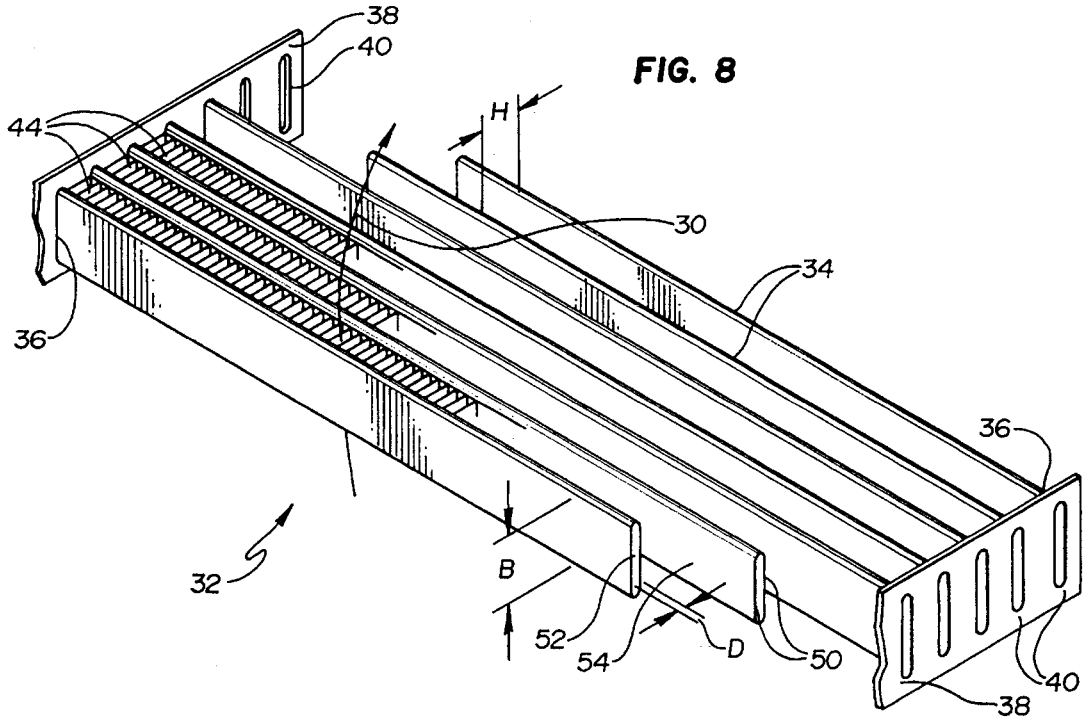
FIG. 8 is a fractionary, perspective view of a flat finned tube heat exchanger.

Referring to FIG. 8, heat exchanger 32 comprises a plurality of heat exchanger tubes 34, seven being shown in the figure for purposes of illustration only—the actual number being typically larger and depending on the specific application. Each tube 34 is welded at each of its ends 36 in a matching recess 40 of a tube sheet 38, and fins 44 are placed between and connected to the tubes. The tubes are of an oblong cross section or flat, as shown, with the width B of a cross section being aligned with the direction of flow of fluid 30; the fins are straight and parallel to each other, and are similarly aligned with the flow of fluid 30. The ensemble formed essentially of tubes, fins, and tube sheets, defines heat exchanger 32. Each tube 34 has, by virtue of its flatness, two parallel walls 50, which constitute partition walls in the heat exchanger, for maintaining the two fluids separated while allowing transfer of heat between them; each tube wall 50 has naturally two flat sides, one flat side 52 being interior to the tube and receiving heat from fluid 28, and the other flat side 54 being exterior and liberating the heat to fluid 30. One or more flat finned tube heat exchanger 32 is installed in the steam condenser by connecting tube sheets 38 to corresponding recesses—not shown—of ducts 24 and 26.

Figure 9:
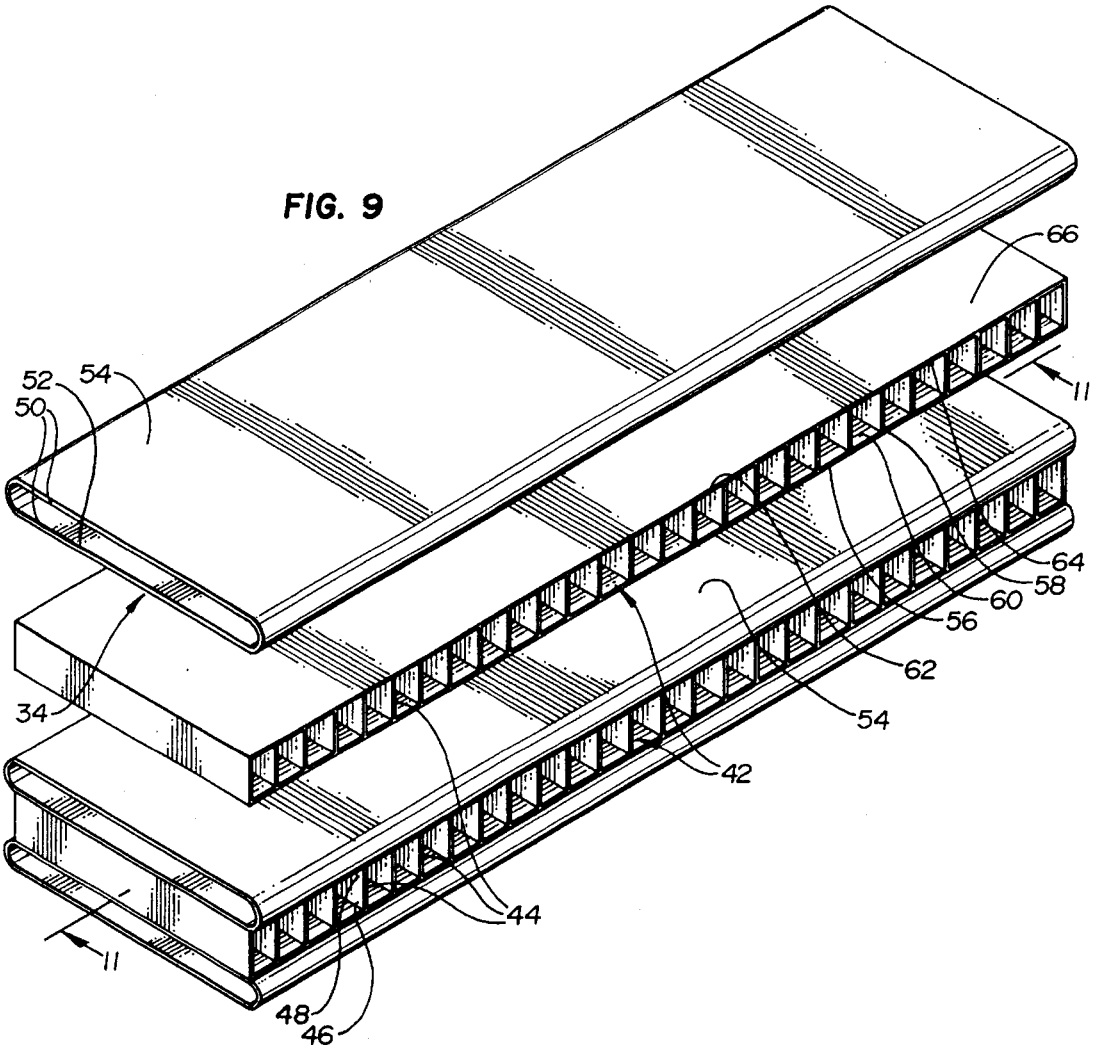
FIG. 9 is a partly exploded, perspective view of an assembly of flat tubes and extended surface packets, in the flat finned tube heat exchanger.
Figure 10:
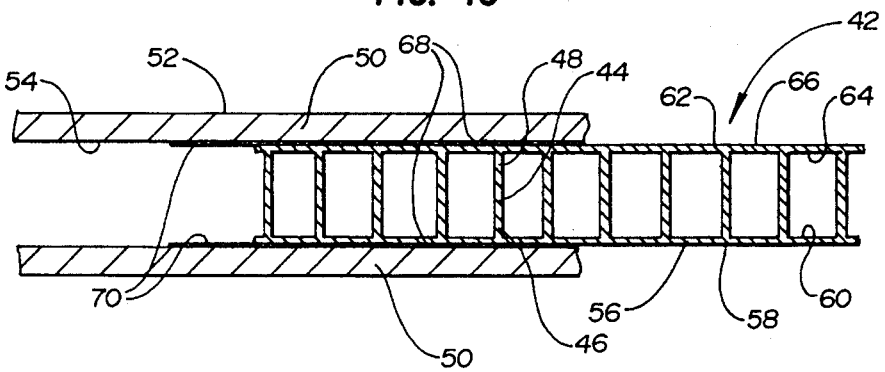
FIG. 10 is a partial cross section view of an extended surface packet bonded to the tube walls.

An understanding of the fins to tube connection, and of the method of assembly can be had by referring to FIG. 9, in which the heat exchanger is represented by only a few tubes and the tube sheets are not shown. As seen from the figure, the fins 44 are connected to the tubes through the intermediary of a base plate 56 and a top plate 62, the base plate 56 having an under face 58 and an tipper face 60, and the top plate 62 having an under surface 64 and an upper surface 66. One base plate 56, together with one top plate 62 and with a multiplicity of fins 44, embody an extended surface packet 42, containing the extended heat transfer surface for heat transfer enhancement. The extended surface packet 42 extends between the confronting walls of two consecutive tubes and is bonded through the entire surface of the under face 58 and the upper surface 66 to the corresponding flat sides 54 of the tube walls. The bonded surfaces are matched to each other and are properly fayed such as to achieve a junction layer 68 of small thickness, compared to the tube wall thickness or the base or top plate thickness.

Figure 11:
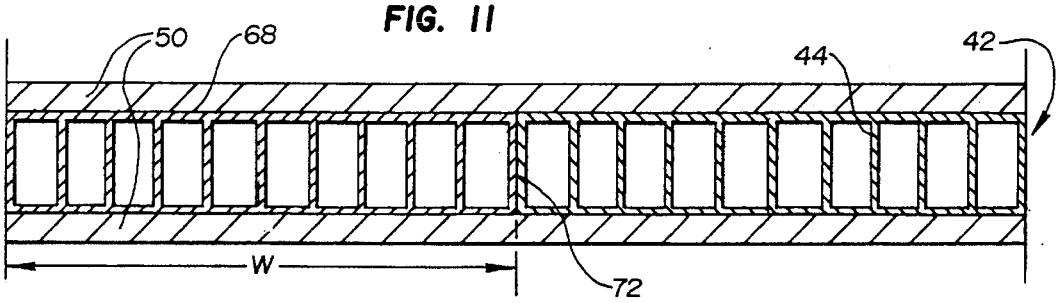
FIG. 11 is a cross section view of two extended surface packets, abutting to each other, and positioned between two neighboring walls.

Extended surface packets 42 are made of aluminum, by extrusion through a die with multiple mandrels, such that the base plate, the associated fins, and the top plate form an integral unit, without internal junctions. The extrusion process produces sections of fin packets with the height equal to the required fin height H, and of a width made as large as permitted by the extrusion press available or as required by the heat exchanger tube length. The extruded sections are very long, and the required dimension B of the fin packets is obtained by cutting the sections with a fusion beam such as a laser. If the extruded sections are not wide enough to cover the entire tube length, two or more packets 42 can be placed side by side along the tube length, as shown in FIG. 11, forming pairs of contacting fins 72 between each two adjacent packets of width W.

The flat tubes 34 are made of steel by one of many possible and simple manufacturing methods, such as flattening a round tube of predetermined diameter in a roll forming machine.

Bonding between the extended surface packets 42 and the tube walls 50 is accomplished with an organic structural adhesive, such as an epoxy-type resin, or similarly a nitrile-phenolic structural adhesive. For the present embodiment, the adhesive is selected from one of the commercially available epoxy-type formulations which cure at room temperatures. These are two-part systems, including the epoxy and a curing agent, which must be kept separate until mixing, prior to application. An example of room temperature curing adhesive is the two-part epoxy SCOTCH-WELD™, produced by the 3M Corporation of St. Paul, Minn. It is formed by mixing two supplied components in a bucket, just prior to the application; the mixture begins to harden in approx. 6 hours, which allows ample work time for the assembly manipulations. Curing to full strength is carried out at room temperature, simply by letting the assembly sit, for approx. 2 days. The maximum temperature of use is of approx. 170° C., which is considerably above the approx. 45° C. operating temperature of a typical steam condenser, and above potential, although rare temperature excursions of up to approx. 100° C. The application of the liquid adhesive is made simply with a brush, or in order to save material, an applicator provide by the 3M Corporation can be utilized. The optimum adhesive thickness is of approx. 0.05 mm, and can be controlled according to that adhesive manufacturer by admixing in the liquid adhesive a small amount of powder formed of calibrated glass beads. If desired, the curing period can be greatly reduced, to approx. 1 hour, by applying heat to raise the parts temperature to approx. 180° C.

Figure 1:
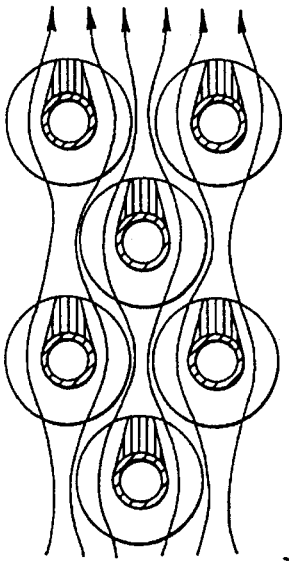
FIG. 1 BACKGROUND ART
FIG. 1, of background art, is a sectional view of round finned tubes in a heat exchanger.
Figure 2:
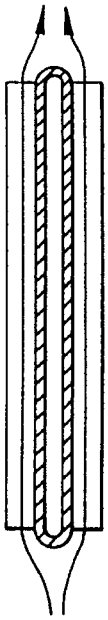
FIG. 2 BACKGROUND ART
FIG. 2, of background art, is a sectional view of a flat finned tube, replacing the round finned tubes of FIG. 1.
Figure 3:
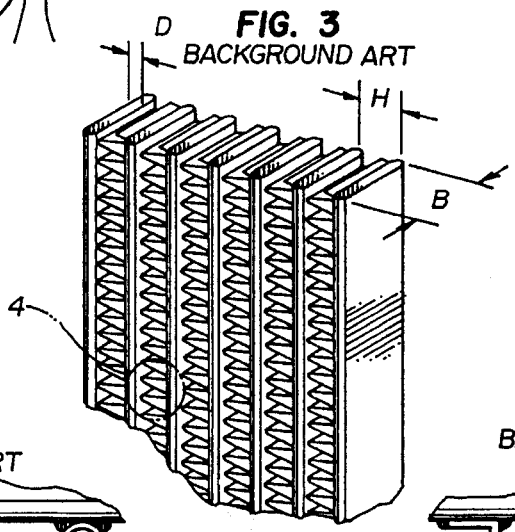
FIG. 3 BACKGROUND ART
FIG. 3, of background art, is a fragmentary perspective view of a flat finned tube heat exchanger.
Figure 4:
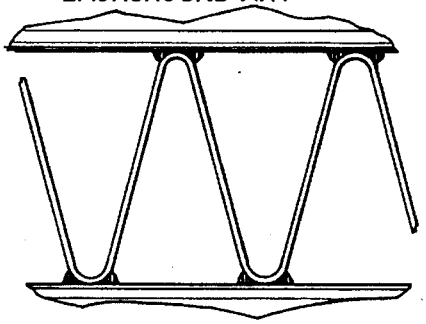
FIG. 4 BACKGROUND ART
FIG. 4, of background art, is an enlarged view of the encircled area of FIG. 3, presenting a waved strip fin.
Figure 5:
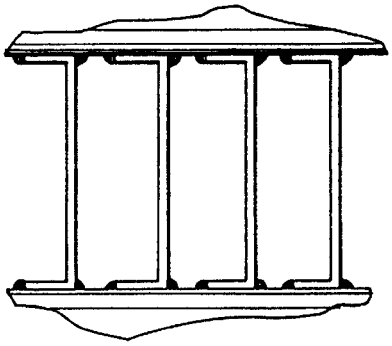
FIG. 5 BACKGROUND ART
FIG. 5, of background art, is an enlarged view of the encircled area of FIG. 3, presenting separately mounted fins.
Figure 6:
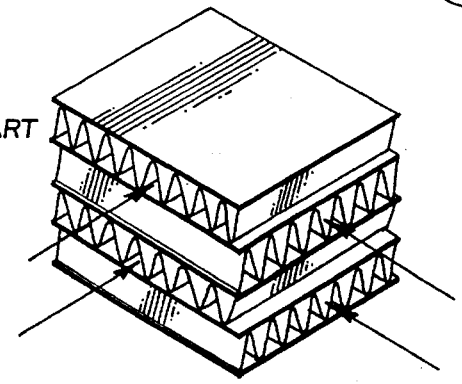
FIG. 6 BACKGROUND ART
FIG. 6, of background art, is a fragmentary perspective view of a plate-fin heat exchanger.

The heat exchanger operation can be summarily described as follows. Flat side 52 of tube wall 50 is receiving heat from fluid 28 flowing inside the tube, and the same amount of heat is liberated through flat side 54 of the tube wall to fluid 30 flowing outside of the tube; by losing heat, fluid 28 is progressively condensing as it advances through the tubes, and is collected in the outlet duct 26, essentially as liquid water, fulfilling the purpose of the steam condenser. Following more in detail the heat flow, it can be seen that the heat flows from the flat side 52, through the thickness of tube wall 50, then through flat side 54; from here it crosses junction 68, arriving at base plate 56 and respectively at top plate 62, in which it spreads laterally, finally entering each fin 44 through fin roots 46 and fin tips 48, being dissipated from the fin surface to flowing fluid 30. While most of the heat transfer path is constituted by metallic parts through which heat is conducted with ease, the heat must also cross junction 68, filled with organic adhesive 70 which has much lower conductivity. Nevertheless, according to the present invention, the heat can cross the junction, with only negligible temperature drop, due to the thinness of the junction and the large cross section of the base and top plates in which the heat flow can spread laterally. This represents a major advantage of the present invention over the prior art, where as shown in FIG. 4, the fin to tube connection was of too small cross section and was too thick to allow heat transfer if bonding were made by an organic structural adhesive.

Another major advantage of the present invention is that junction 68, connecting the fins to the tube is essentially sealed from the environment by the base plate and the top plate. This is in contrast to the prior art, where each fin was joined to the tube by narrow and very long linear junctions which were exposed to corrosion and other damaging effects of the environment. Bonding with an organic structural adhesive could not be applied by the prior art since the directly exposed linear junctions would deteriorate in relatively short time by the action of even small amounts of moisture contained in the cooling air. Yet another advantage of the invention can be seen from the :foregoing description, in that the bond achieved between the fins base plate and the tube is of high strength due to the relatively large extent of the contact areas, in contrast to the line contacts of the prior art. The tube strength is also increased by connecting the fins to each two adjacent tubes, as shown, allowing operation without any noticeable tube deformation at the negative steam pressures encountered in steam condensers.

Since the manufacturing process is carried at low temperature, the strength of the aluminum alloy constituting the fins is preserved, and its corrosion resistance properties are not altered. If exceptionally high corrosion resistance is required, fin packets 42 can be anodized and tubes 34 can be coated with a corrosion protection primer prior to the bonding step. This was certainly not possible with the prior art based on high temperature brazing.

Other closely related embodiments of the invention can be obtained by replacing one or both fluids 28 and 30 with fluids other than steam and air, or by changing the heat exchanger sizes. Thus, a water cooler can be obtained, with a similar arrangement to that shown above, and with fluid 28 constituted by water. Various other fluids can also be cooled, such as a process fluid in a chemical process. And, with much reduced dimensions and with fluid 28 constituted of engine coolant, the heat exchanger can also be used as a car radiator. Numerous similar variations and potential applications can be envisioned.

Figure 12:
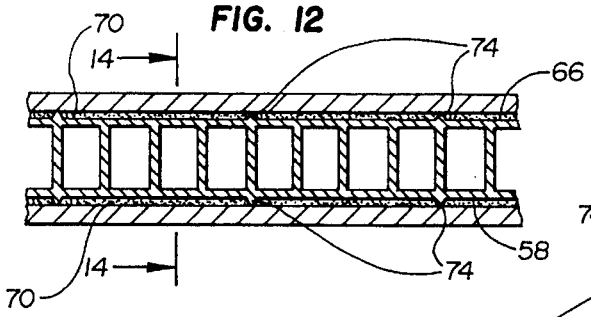
FIG. 12 is a partial sectional view of an extended surface packet provided with spacer ridges, and mounted between two neighboring walls.
Figure 13:
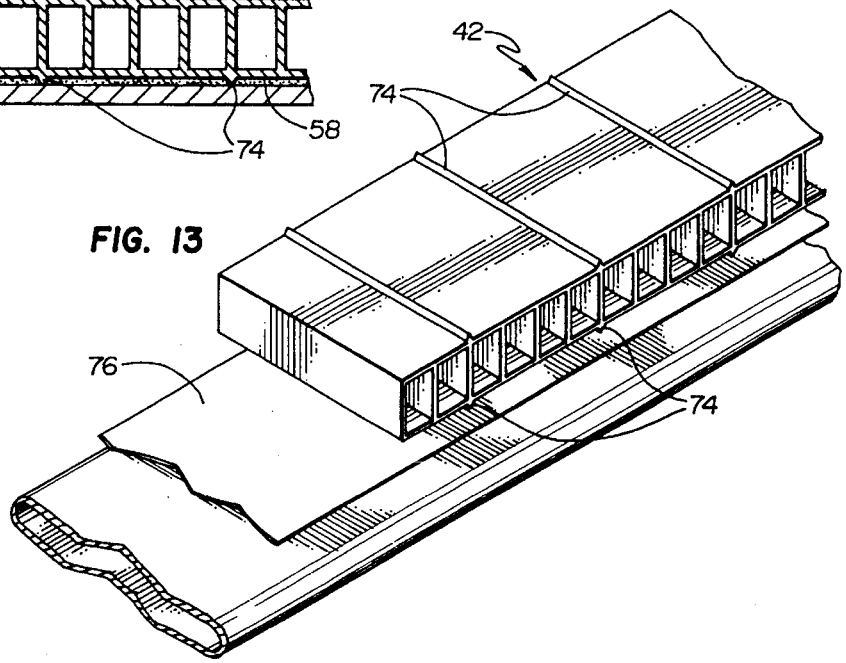
FIG. 13 is a perspective view of a tube assembly prepared for brazing with a brazing sheet.
Figure 14:
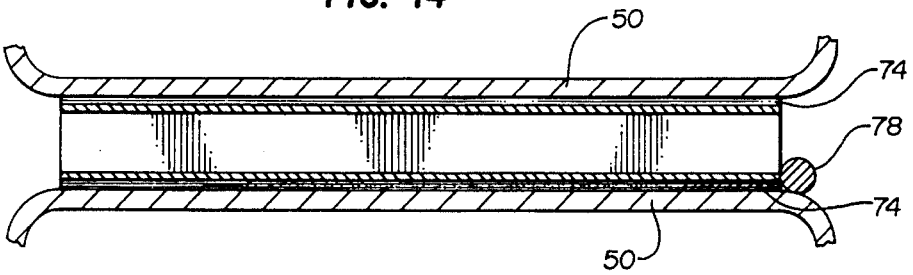
FIG. 14 is a cross section view of a tube assembly prepared for soldering with a soldering rod.

If the heat exchanger operating temperature is greater than about 170° C., but less than about 400° C., a variation of the embodiment presented above can be achieved by replacing bonding by organic adhesive with bonding by aluminum brazing; for an intermediate temperature range soldering can be applied. To facilitate brazing and soldering, the extended surface packets 42 are modified by including a plurality of spacer ridges 74, on under face 58 and upper surface 66, as shown in FIGS. 12 and 13. The spacer ridges are formed integrally with the rest of the packet by the extrusion process discussed above, by a corresponding modification of the extrusion die. Brazing is performed with brazing alloy sheets 76 placed between packets 42 and tubes 34, compressing the ensuing assembly, e.g. by weights placed on the topmost tube, and raising the temperature in a brazing furnace to a level sufficient to melt the brazing alloy but below the solidus of the fin packet aluminum material. The molten brazing alloy spreads evenly, by capillary forces, in the interstices defined by spacer ridges 74, achieving the bond upon cooling. The steps of the brazing process are only summarily described here since these must be obvious to many skilled in the widely practice art of aluminum brazing. Soldering can be achieved similarly, by placing the solder metal in the form of solder metal rod 78, adjacent to one edge of the packet 42 and tube 34 as shown in FIG. 14, and raising the temperature to melt the solder metal which is then filling the interstices created by ridges 74, by capillary forces as before.

Brazing and soldering of the tube and fin assemblies by the method of the present invention represent an improvement over the prior art methods of bonding individual fins, since the narrow and very long junctions of the individual fins are eliminated, and the bonding filler material 70 is now substantially sealed from the environment by the base and top plates of the fin packets. The bond strength is likewise increased. These features of the invention are particularly important for soldering, which is of less strength and less corrosion resistant than brazing, but has the advantage of being a lower temperature manufacturing process, avoiding the softening of the aluminum fins encountered with brazing.

Figure 15A:
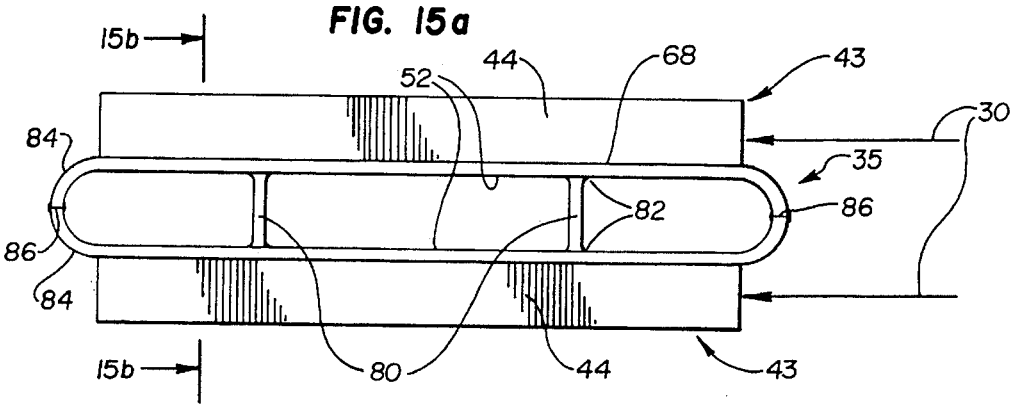
FIG. 15*a* is a cross section view of an independent flat finned tube with internal pressure supporting struts.
Figure 15B:
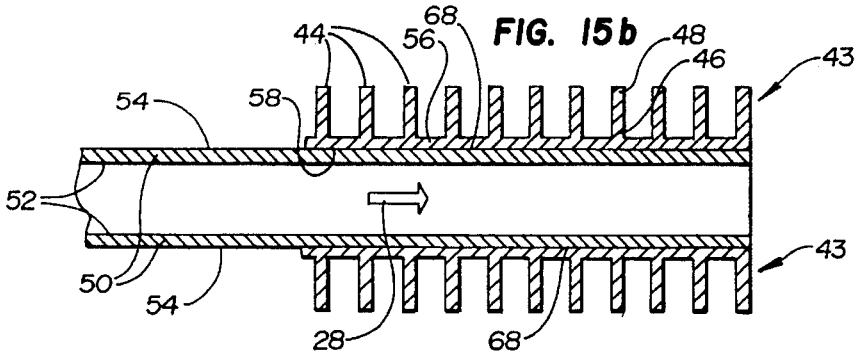
FIG. 15*b* is a cross section view as seen from line 15*b*—15*b* of FIG. 15*a;*

In another embodiment, the flat finned tubes of the present invention are constructed for application with high temperature and high pressure fluids, e.g., for application as boiler tubes in heat recovery steam generators. The tubes are made independent of each other for possible replacement over the long term maintenance cycles of the equipment. Details of this embodiment are presented in FIGS. 15*a* and 15*b*. As shown in the figures, the extended surface packet 43 is made integral and includes base plate 56 and fins 44, but no top plate, the fin tips 48 not being connected to the neighboring tube, in difference from the embodiments described above. Fluid 28 circulating inside the tubes is high pressure steam, and fluid 30 flowing over the tubes is a mixture of high temperature combustion gases. To withstand the high pressure, the flat tube 35 is provided with a multiplicity of internal columns, or pins, or struts 80, each of the struts 80 being attached at its two ends 82 to the internal flat side 52 of the tube, by welding. In order to facilitate the insertion and welding of struts 80, tube 35 is made from two identical shells 84, welded together along longitudinal edges 86. Attachment of the struts is preferably by electric resistance welding. Tubes 35 and the extended surface packets 43 are made of stainless steel, or of another high temperature metal. The extended surface packets 43 are manufactured preferably by metal cutting machining, e.g., with a shaping machine; alternatively, packets 43 can be forged to approximate dimensions prior to finish by machining. The under face 58 of packet 43 and the flat side 54 of tube 35 are polished and properly fayed with each other to achieve close contact. Attachment of packets 43 to tubes 35 is by diffusion bonding, achieved in a high temperature furnace in which the parts are maintained for a sufficient length of time under a compressive force provided by weights placed on top of the tube assembly. At the high temperature the atoms of the two contacted metals diffuse across the junction and among each other creating the bond. Details of this bonding process are well known to those skilled in the art of metal bonding and are therefore not included here. Bonding is thus achieved without an extraneous filler material, providing a junction 68 of high strength and high corrosion resistance, and a very good thermal contact, with negligible temperature drop across the junction. The operation of the heat exchanger is similar to that described above, except that the direction of heat flow is reversed, heat being now liberated by the combustion gases 30 flowing over the tubes, and being received by the high pressure fluid 28 circulated inside the tubes. Other applications of this high temperature flat finned tube can be envisioned, among which is the important application to a gas turbine recuperator.

Figure 16:
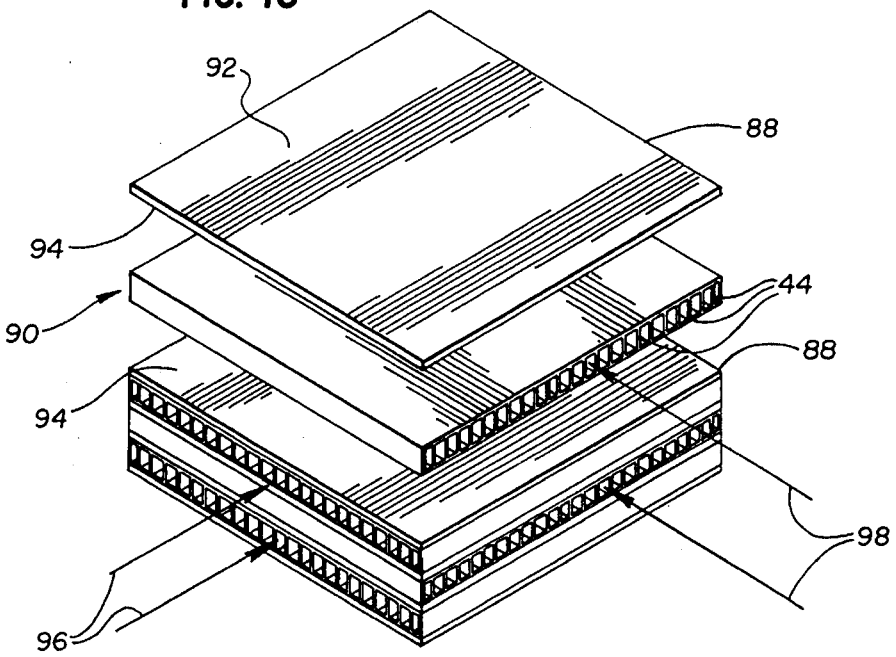
FIG. 16 is a partly exploded, perspective view of a plate heat exchanger including extended surface packets.

Another embodiment is the plate-fin heat exchanger, including elements of the present invention, as presented in FIG. 16. In this embodiment the partition walls are formed by a system of parallel plates 88, and extended surface packets 90 (similar to the packets 42 used above with tubes) are attached on both flat sides 92 and 94 of each plate. The plates are of aluminum, and the extended surface packets are of aluminum and made by extrusion as described above. Attachment of the fin packets 90 to the plates 88 is by organic structural adhesive bonding. A first fluid 96, flowing over the first flat side 92, is exchanging heat with a second fluid 98, flowing over the second flat side 94. Variations of this embodiment can be envisioned, in which the plates and fins are made of materials other than aluminum, and the attachment can be by brazing for higher temperature applications.

Thus, in the heat exchangers of the present invention, groups of fins are connected to the walls of flat tubes through the intermediary of base plates and top plates made integral with the fins, eliminating the individual fin junctions of the prior art. The method of fin to wall connection, according to the invention, can also be applied to plate-fin heat exchangers, and in fact to any heat exchanger with flat partition walls separating two fluids. The finned surface is supplied in the form of extended surface packets, provided each with a common base plate, and attached to the tube walls by the base plates. The attachment is thus performed between two surfaces of adequate extent, intimately contacting each other, producing a structure of high strength and with the junction layers sealed away from the corrosion action of the environment. The tube and fin materials can be selected from a wide range of available materials, which can be similar or dissimilar, metallic or even non-metallic, thus permitting ample design flexibility. Bonding methods which are superior to those of the prior art can be applied, such as organic structural adhesive bonding for low operating temperatures, and diffusion bonding for high temperatures.

I claim:

1. A heat exchanger comprising:

a plurality of parallel tubes, each having an oblong cross section with flat side walls separating a first fluid from a second fluid, the first fluid flowing through the interior of the tubes and parallel with a longitudinal tube axis, and the second fluid flowing over the exterior of the tubes;

means for directing the fluids in and out of the heat exchanger;

at least one extended surface packet for heat transfer enhancement, each packet comprising at least three fins, a base plate, and a top plate being made materially continuous and formed integrally in one piece with no internal junctions from a heat conductive material;

the fins of each said extended surface packet being substantially parallel with each other and aligned with a direction of flow of the second fluid;

the base plate having an under face and an upper face opposed to each other, the under face being essentially planar, and the upper face having said fins extending away from and in substantially perpendicular relation to the base plate;

the top plate having an upper surface and an under surface opposed to each other, the upper surface being essentially planar, and the under surface having said fins extending away from and in substantially perpendicular relation to the top plate;

the under face of said base plate contacting one of the flat side walls of one of said tubes, the upper surface of said top plate contacting one of the flat side walls of an adjacent one of said tubes;

bonding means for attaching each said extended surface packet to the flat side walls of said tubes; said bonding means being applied essentially over an entire surface of the base plate under face and the top plate upper surface;

wherein one of said base plate under face and said top plate upper surface includes a plurality of integral spacer ridges.

2. The heat exchanger of claim 1, wherein the tubes are made of a ferrous metal, the extended surface packets are made of aluminum, and the bonding means is solder or braze material.

3. The heat exchanger of claim 1, wherein the first fluid is steam and the second fluid is ambient air.

4. The heat exchanger of claim 1, wherein the first fluid is engine coolant and the second fluid is ambient air.

5. The heat exchanger of claim 1, wherein the spacer ridges are parallel with the fins.

6. The heat exchanger of claim 1, wherein each fin has a thickness of less than 0.5 mm.

* * * * *